US006430788B1

(12) United States Patent
Putnam et al.

(10) Patent No.: US 6,430,788 B1
(45) Date of Patent: Aug. 13, 2002

(54) HYDROENTANGLED, LOW BASIS WEIGHT NONWOVEN FABRIC AND PROCESS FOR MAKING SAME

(75) Inventors: Michael Putnam, Benson, NC (US); Richard Ferencz, Charleston, SC (US); Marlene Storzer; Jian Weng, both of Mooresville, NC (US)

(73) Assignee: Polymer Group, Inc., North Charleston, SC (US)

( * ) Notice: Subject to any disclaimer, the term of this patent is extended or adjusted under 35 U.S.C. 154(b) by 0 days.

(21) Appl. No.: 09/475,586

(22) Filed: Dec. 30, 1999

(51) Int. Cl.[7] ..... D04H 3/10
(52) U.S. Cl. ..... 28/104
(58) Field of Search ..... 28/104, 105, 106, 28/167, 103, 166; 428/219; 442/408, 394

(56) References Cited

U.S. PATENT DOCUMENTS 3,485,706 A 12/1969 Evans
4,024,612 A * 5/1977 Contractor et al. ..... 28/105
4,774,110 A * 9/1988 Murakami et al. ..... 28/104
4,775,579 A * 10/1988 Hagy et al. ..... 28/104
4,805,275 A 2/1989 Suzuki et al.
4,939,016 A * 7/1990 Radwanski et al. ..... 28/104
5,098,764 A 3/1992 Drelich et al.
5,114,787 A * 5/1992 Chaplin et al. ..... 28/104
5,144,729 A * 9/1992 Austin et al. ..... 28/105
5,369,858 A 12/1994 Gilmore et al.
5,516,572 A 5/1996 Roe
5,573,841 A * 11/1996 Adam et al. ..... 28/104
5,759,929 A * 6/1998 Ikezawa et al. ..... 28/104
5,822,833 A 10/1998 James et al.
6,063,717 A * 5/2000 Ishiyama et al. ..... 28/104

* cited by examiner

*Primary Examiner*—Amy B. Vanatta
(74) *Attorney, Agent, or Firm*—Wood, Phillips, Katz, Clark & Mortimer

(57) ABSTRACT

A process is disclosed for hydroentangling polymeric filament webs for production of low basis weight nonwoven fabrics. A three-dimensional image transfer device is employed for patterning a precursor web to form a fabric preferably having a rectilinear pattern. High-speed production of relatively low basis weight fabrics can be achieved, with the fabrics exhibiting desired softness, uniformity, and strength characteristics.

7 Claims, 1 Drawing Sheet

HYDROENTANGLED, LOW BASIS WEIGHT NONWOVEN FABRIC AND PROCESS FOR MAKING SAME

TECHNICAL FIELD

The present invention relates generally to nonwoven fabrics, and methods for producing such fabrics, and more particularly to a hydroentangled, low basis weight nonwoven fabric exhibiting desirable softness and strength characteristics in a three-dimensional patterned form, with manufacture from a lightly bonded precursor web facilitating efficient and high-speed production.

BACKGROUND OF THE INVENTION

Nonwoven fabrics are used in a wide variety of applications where the engineered qualities of the fabric can be advantageously employed. These types of fabrics differ from traditional woven or knitted fabrics in that the fibers or filaments of the fabric are integrated into a coherent web without traditional textile processes. Entanglement of the fibrous elements of the fabric provides the fabric with the desired integrity, with the selected entanglement process permitting fabrics to be patterned to achieve desired aesthetics.

Various prior art patents disclose techniques for manufacturing nonwoven fabrics by hydroentangling processes. U.S. Pat. No. 3,485,706, to Evans, hereby incorporated by reference, discloses a hydroentanglement process for manufacture of nonwoven fabrics. Hydroentanglement entails the application of high-pressure water jets to webs of fibers or filaments, whereby the fibers or filaments are rearranged under the influence of water impingement. The web is typically positioned on a foraminous forming surface as it is subjected to impingement by the water jets, whereby the fibers or filaments of the web become entangled, thus creating a fabric with coherency and integrity, while the specific features of the forming surface act to create the desired pattern in the nonwoven fabric. However, there is no teaching or suggestion in Evans '706 to form a fabric upon a three-dimensional forming surface.

Heretofore, typical hydroentanglement of relatively low basis weight fabrics with the Evans-type technology has been problematic. At low basis weights (on the order of less than 30 grams per square meter), there are a relatively low number of fibers or filaments present for entangling, thus making entanglement relatively inefficient. Entanglement of these light basis weight webs on traditional forming surfaces taught by Evans and its progeny tends to "wash" the low fiber content webs, rearranging the fibers in a fashion which undesirably results in a non-uniform product. Entanglement of these low basis weight webs at relatively high processing speeds compounds the problem of maintaining uniformity, because the impinging water jet flows and/or pressures must be relatively increased, which increases the undesirable tendency to distort the web. Further, the high energy jets required by high speed entangling processes tend to drive the fibers into the drain hole openings of the foraminous surface, or into the interstitial spaces of a woven forming wire. This creates serious difficulties with web transfer.

U.S. Pat. No. 5,369,858, to Gilmore et al., discloses a process for forming apertured nonwoven fabric from melt-blown microfibers using the Evans-type technology. These types of fibers are attenuated during known melt-blowing formation techniques, whereby the fibers have relatively small diameters. This patent discloses the use of a belt or drum forming surface having a perforated or foraminated forming surface. Plural hydroentangling manifolds act against fibers positioned on the forming surface to displace the fibers from "knuckles" of the forming surface, and into openings or lower parts of the forming surface topography, as in Evans. This patent contemplates use of a polymeric net or scrim for fabric formation, and the formation of fabric having apertures therein of two different sizes, including formation of fabric from a first layer of textile fibers or polymeric filaments, and a second layer of melt-blown microfibers.

U.S. Pat. No. 5,516,572, to Roe, discloses a disposable absorbent article including a liquid pervious topsheet, wherein the topsheet comprises a nonwoven fabric prepared from a homogeneous admixture of melt-blown fibers and staple length synthetic fibers. The patent contemplates that fabrics formed in accordance with its teachings comprise a blend including up to 50% by weight of melt-blown fibers.

U.S. Pat. No. 4,805,275, to Suzuki et al., also discloses a method for forming nonwoven fabrics by hydroentanglement. This patent contemplates that hydroentanglement of a fibrous web be effected on a non-three-dimensional smooth-surfaced water-impermeable endless belt, but notes that at fabric weights below 15 grams per square meter that irregularities in the fibrous web occur, and fabrics with substantial uniformity cannot be obtained.

In contrast to the above-referenced patents, the present invention contemplates a process employing a three-dimensional image transfer device for forming relatively low basis weight nonwoven fabrics, which can be efficiently practiced for manufacture of patterned fabrics having a high degree of uniformity. Such uniformity facilitates use of such fabrics in a wide variety of applications, with efficient formation facilitating economical use.

SUMMARY OF THE INVENTION

A process of making a nonwoven fabric having a low basis weight in accordance with the principles of the present invention contemplates hydroentangling on a three-dimensional image transfer device of a precursor web comprising spunbonded continuous polymeric filaments. As is known in the art, spunbonding entails extrusion or "spinning" of thermoplastic polymeric material with the resultant filaments cooled and drawn or attenuated as they are collected. The continuous, or essentially endless, filaments may be bonded, with the process of the subject invention contemplating that such spunbonded material be employed as the precursor web.

To form relatively low basis weight fabrics, a precursor web having a basis weight from about 10 to about 30 grams per square meter is employed. The present invention further contemplates that a three-dimensional image transfer device be provided, with the transfer device having a fabric-forming surface defined between three-dimensional surface features. Preferably, at least some of the surface features have profiles which converge toward each other in a direction toward the fabric-forming surface, with the presently preferred image transfer device comprising rectilinear pyramidal array.

With the precursor web positioned on the image transfer device, hydroentanglement is effected by application of high pressure liquid streams to the web. Filaments of the web are rearranged by the fabric-forming surface of the image transfer device, including movement of at least some of the filaments off of the three-dimensional surface features of the device to regions of the forming surface between adjacent ones of the surface features. In the preferred embodiment, wherein a pyramidal array is employed for the image transfer device, filaments are displaced and compacted under the influence of the liquid streams, to regions between adjacent ones of the pyramids of the array. The three-dimensional image transfer device, thus acts in concert with the high pressure liquid streams, to rearrange the filaments of the precursor web relative to the (vertical) Z-axis of the web, as well as relative to the X-axis and Y-axis.

A low basis weight web formed in accordance with the present invention comprises a web of hydroentangled polymeric filaments having a denier from 0.2 to 3.0. The filaments are arranged in a substantially uniform array including interconnected bundles of filaments surrounding apertures extending through the web. The fabric has a basis weight of from about 10 to about 30 grams per square meter, a cross-direction tensile strength of at least about 64 grams per centimeter at 59% cross direction elongation, and a machine direction tensile strength of at least about 242 grams per centimeter at 24% machine-direction elongation.

Notably, the characteristics of the spunbonded precursor web, in particular the strength of its bonds, has a direct influence on the strength characteristics of the resultant low basis weight fabric. Development has shown that if the spunbound precursor web is only relatively lightly bonded, hydroentanglement acts to break or disrupt the bonds without substantially breaking the continuous filaments from which the spunbond precursor web is formed. As a consequence, a low basis weight fabric formed in accordance with the present invention may be formed to include substantially continuous filaments (from a relatively lightly bonded spunbond precursor web), with the resulting fabric having a machine direction tensile strength of at least about 550 grams per centimeter at 50% machine-direction elongation. The degree of bonding of the precursor web is specifically selected to facilitate handling of the web, with the contemplation that higher strength fabrics can be achieved if the filaments of the precursor web are maintained in a substantially continuous form. In accordance with the present invention, it is contemplated that the spunbond precursor web is subjected to bonding which provides no more than a minimum tensile strength which permits winding and unwinding of the precursor web. Thus, the minimal tensile strength of the precursor web is selected to facilitate efficient handling during manufacturing of the present low basis weight nonwoven fabric.

Other features and advantages of the present invention will become readily apparent from the following detailed description, the accompanying drawings, and the appended claims.

DETAILED DESCRIPTION

Figure 1:
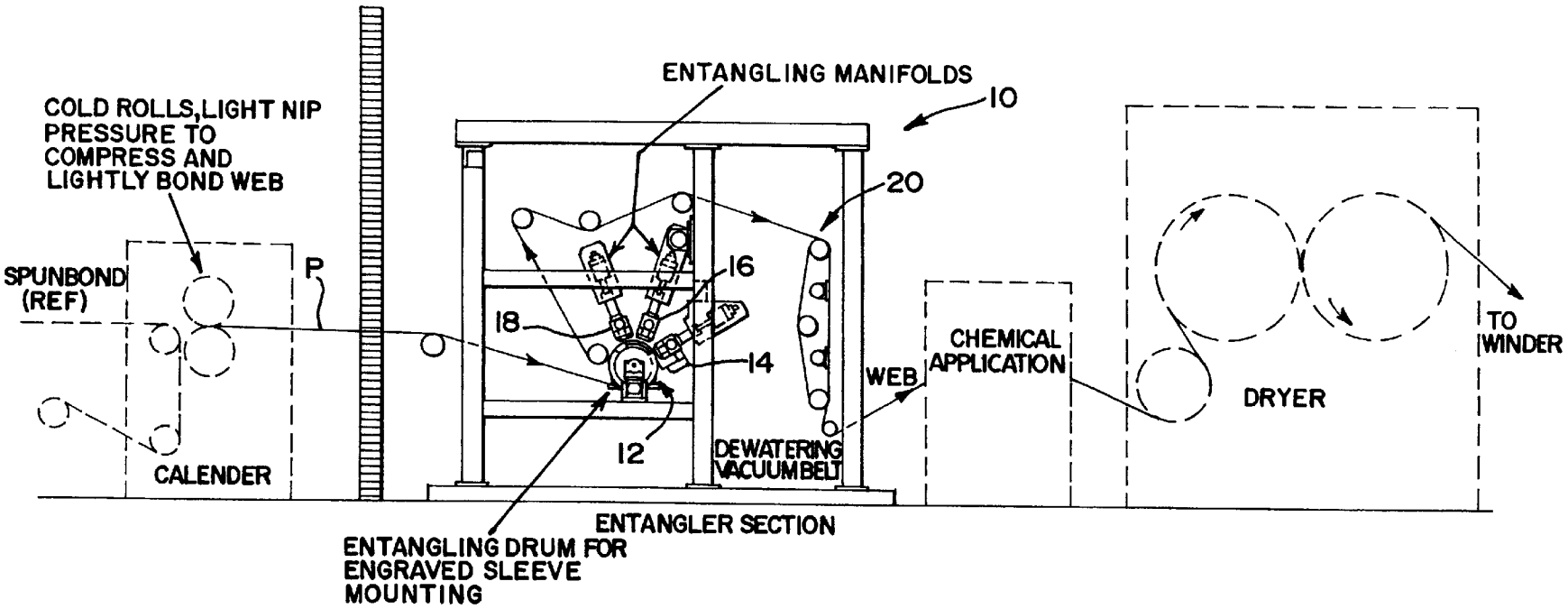
FIG. 1 is a diagrammatic view of a hydroentangling apparatus for practicing the process of the present invention, whereby low basis weight nonwoven fabrics embodying the principles of the present invention can be formed.

While the present invention is susceptible of embodiment in various forms, there is shown in the drawings and will hereinafter be described a presently preferred embodiments, with the understanding that the present disclosure is to be considered as an exemplification of the invention, and is not intended to limit the invention to the specific embodiment illustrated.

With reference to FIG. 1, therein is illustrated a hydroentangling apparatus, generally designated 10, which can be employed for practicing the process of the present invention for manufacture of a relatively low basis weight nonwoven fabric. The apparatus is configured generally in accordance with the teachings of U.S. Pat. No. 5,098,764, to Drelich et al., hereby incorporated by reference. The apparatus 10 includes an entangling drum 12 which comprises a three-dimensional image transfer device upon which hydroentangling of a precursor web is effected for formation of the present nonwoven fabric. The image transfer device includes a fabric-forming surface defined between three-dimensional surface features of the device. At least some of the features have profiles which converge toward each other in a direction toward the fabric-forming surface, with the image transfer device defining drain openings positioned between adjacent ones of the surface features.

In the presently preferred practice of the present invention, a rectilinear pyramidal array is employed for the three-dimensional image transfer device of entangling drum 12. Above-referenced U.S. Pat. No. 5,098,764, to Drelich et al., discloses various configurations for pyramidal arrays of the type which can be employed for the image transfer device of entangling drum 12. The following describes one of the forming surfaces which can be provided on the image transfer device for manufacture of the subject low basis weight nonwoven fabric.

The terminology "20×20" refers to a rectilinear forming pattern including an array of pyramids, wherein the pyramids are configured in a 20 per inch×20 per inch array, in accordance with FIG. 13 of U.S. Pat. No. 5,098,764. In contrast to the arrangement illustrated in FIG. 13 in the above-referenced patent, mid-pyramid drain holes (designated by reference numeral 109) are omitted. Drain holes are thus present at each corner of each pyramid, i.e., four holes surround each pyramid. Pyramid height is 0.025 inches, with drain holes having a diameter of 0.02 inches. Drainage area is 12.5% of the surface area.

In the apparatus illustrated in FIG. 1, a plurality of hydroentangling manifolds, designated 14, 16, and 18, act sequentially upon a precursor web P trained about entangling drum 12. The precursor web P may be formed in-line with the entanglement apparatus, as generally illustrated in phantom line, or may be provided in the form of rolls of material fed into the entangling apparatus for processing.

While it is within the purview of the present invention to employ various types of precursor webs, including fibrous and continuous filament webs, it is presently preferred to employ spunbonded continuous filament webs comprising polymeric filaments, preferably polyester (polyethylene terephthalate). Filament denier is preferably 0.2 to 3.0, with 1.5 denier filaments being particularly preferred. The precursor web preferably has a basis weight from about 10 to 30 grams per square meter, more preferably from about 15 to 20 grams per square meter. Use of continuous filament precursor webs is presently preferred because the filaments are essentially endless, and thus facilitate use of relatively high energy input during entanglement without undesirably driving filaments into the image transfer device, as can occur with staple length fibers or the like. Use of a three-dimensional forming surface acts to desirably control fiber movement during entanglement, with the process producing lightweight nonwoven products at relatively high speed, thus permitting modem high speed and lightweight web forming systems to be fully utilized. The preferred use of filamentary precursor webs permits the filament to be subjected to elevated hydraulic energy levels without undesirable fouling of the pattern or drain holes of the image transfer device. Thus, fabrics are formed without substantially altering the basis weight of the precursor webs.

A particular benefit of finished fabrics formed in accordance with the present invention is uniformity of patterning. Fiber movement from the water jets from the hydroentangling manifolds is controlled by the shape and depth of the forming surface and drainage design. The use of higher pressures and flows is desirably achieved, thus permitting processing of webs at high speeds and low basis weights. Finished products in the 10 to 30 grams per square meter range are produced at operating speeds up to hundreds of feet per minute.

The following are examples of low basis weight nonwoven fabrics formed in accordance with the present invention. Reference to manifold pressures is in connection with water pressure, in pounds per square inch (psi), in the successive hydroentangling manifolds 14, 16, and 18, illustrated in FIG. 1. Each of these manifolds included orifice strips having 33.3 holes or orifices per inch, each having a diameter of 0.0059 inches. All examples were made using a single pass beneath the hydroentangling manifolds, with each manifold acting against the same side of the precursor web to form the resultant fabric. Testing of fabrics was conducted in accordance with ASTON testing protocols.

A lightly bonded precursor web, as referenced below, may be produced on a commercial spunbond production line using standard processing conditions, except thermal point bonding calender temperatures are reduced, and may be at ambient temperature (sometimes referred to as cold calendering). For example, during production of standard polyester spunbond, the thermal point bonding calender is set at a temperature of 200 to 210 degrees C. to produce the bonded finished product. In contrast, to prepare a similar precursor web for subsequent entangling and imaging, the calender temperature is reduced to 160 degrees C. Similarly, during production of standard polypropylene spunbond products, the common thermal point calender conditions are 300 degrees F., and 320 pounds per linear inch (PLI) nip pressure. For a lightly bonded polypropylene precursor web to be entangled and imaged, these conditions are reduced to 100 degrees F. and 100 PLI. For the lightly bonded spunbond precursor web used for Example 1; calender temperature was 100 degrees F., with nip pressure of 100 PLI.

EXAMPLE 1

A lightly bonded spunbond polyester precursor web was employed having a basis weight of 28 grams per square meter, with 1.8 denier filaments. The precursor was lightly bonded as described above. The precursor web was entangled at 80 feet per minute, with successive manifold pressures of 700, 4,000, and 4,000 psi. A 20×20 three-dimensional image transfer device was employed. Energy input was 3.2 horsepower-hour per pound. The resultant fabric exhibited a basis weight of 28 grams per square meter, a bulk of 0.380 millimeter, a cross-direction strip tensile strength of 310 grams per centimeter, at a cross-direction elongation of 77%, and a machine direction strip tensile strength of 550 grams per centimeter at a machine direction elongation of 50%.

EXAMPLE 2

A more heavily bonded polyester filament precursor web was employed having a basis weight of 19.8 grams per square meter, and a filament denier of 1.8. The precursor web was bonded as described above, except with a calender temperature of 300 degrees F., and a nip pressure of 320 PLI. An image transfer device having a 20×20 three-dimensional image transfer device was employed. The precursor web was entangled at a speed of 100 feet per minute, with successive manifold pressures of 700, 4,000, and 4,000 psi. Energy input was 3.6 horsepower-hour per pound. The resultant nonwoven fabric exhibited a basis weight of 19.8 grams per square meter, a bulk of 0.320 millimeters, a cross-directional strip tensile strength of 76 grams per centimeter at a cross-directional elongation of 59%, and a machine direction strip tensile strength of 257 grams per centimeter at a machine direction elongation of 22%.

EXAMPLE 3

A relatively heavily bonded polypropylene spunbond/melt-blown/spunbond precursor web was employed having a basis weight of 18.3 grams per square meter, with polypropylene filament denier of 1.5. The precursor web was bonded as described in Example 3 The precursor web was hydroentangled at a rate of 100 feet per minute on a 20×20 three-dimensional image transfer device. The hydroentangling manifolds were operated at successive pressures of 700, 4,000, and 4,000 psi, to provide a horsepower-hour per pound energy input of 3.9. A resultant fabric had a basis weight of 18.3 grams per square meter, a bulk of 0.29 millimeters, a cross-directional strip tensile strength of 64 grams per centimeter at a cross-directional elongation of 59%, and a machine direction strip tensile strength of 242 grams per centimeter at a machine direction elongation of 24%.

EXAMPLE 4

A relatively well bonded polypropylene spunbond web having a basis weight of 18.7 grams per square meter was employed as the precursor web, with filament denier of 1.5 The precursor web was bonded as described in Example 3. The precursor web was processed for hydroentangling at a speed of 240 feet per minute on a 20×20 three-dimensional image transfer device. The hydroentangling manifolds were operated at successive pressures of 100, 4,000, and 4,000 psi. Energy input was 1.6 horsepower-hour per pound. The resultant fabric exhibited a basis weight of 18.7 grams per square meter, a bulk of 0.27 millimeters, a cross-direction strip tensile strength of 87 grams per centimeter at a cross-direction elongation of 57%, and a machine direction strip tensile strength of 291 grams per centimeter at a machine direction elongation of 17%.

It will be noted from the above that Example 1 exhibited relatively greater tensile strength characteristics than Examples 2, 3, and 4. It has been observed that this is a result of the degree of bonding of the precursor web for the various examples. In Example 1, a relatively lightly bonded precursor web was employed and it is believed that when this type of web is subjected to hydroentanglement, there is a breakage or disruption of the bonds without significant breakage of the polymeric filaments of the precursor web. In contrast, Examples 2, 3, and 4, employed precursor webs which were relatively well-bonded, and thus, during hydroentanglement, disruption and breakage of the filament bonds is believed to have resulted in a relatively higher degree of filament breakage.

TABLE 1

| EXAMPLE # | BASIS WT. ($g/m^2$) | BULK (mm) | CD STRIP TENSILE (g/cm) | CD ELONGATION (%) | MD STRIP TENSILE (g/cm) | MD ELONGATION (%) |
|---|---|---|---|---|---|---|
| 1 | 28 | 0.380 | 310 | 77 | 550 | 50 |
| 2 | 19.8 | 0.320 | 76 | 59 | 257 | 22 |
| 3 | 18.3 | 0.290 | 64 | 59 | 242 | 24 |
| 4 | 18.7 | 0.270 | 87 | 57 | 291 | 17 |

Fabrics formed in accordance with the present invention are desirably lightweight, exhibiting desirable softness and bulk characteristics. Fabrics produced in accordance with the present invention are useful for nonwoven disposable products such as diaper facing layers, with the present fabrics exhibiting improved softness compared to typical spunbonded materials. The present fabrics are preferable to thermally bonded lightweight webs, which tend to be undesirably stiff. It is believed that fabrics in accordance with the present invention can be readily employed in place of traditional point bonded and latex bonded nonwoven fabrics, dependent upon basis weight and performance requirements.

Precursor webs used in the above Examples which were characterized as lightly bonded were formed as specified, whereby the precursor web was bonded to exhibit no more than a minimal tensile strength which permits winding and unwinding of the web. If hydroentanglement is effected in-line with production of a spunbond precursor web, the precursor web may be lightly bonded a sufficient degree as to permit efficient movement of the precursor web into the hydroentangling apparatus.

As illustrated in FIG. 1, subsequent to hydroentanglement, the fabric being formed may be subjected to dewatering, as generally illustrated at 20, with chemical application (if any) and typical drying of the fabric thereafter effected.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover, by the appended claims, all such modifications as fall within the scope of the claims.

What is claimed is:

1. A process for making a nonwoven fabric having a low basis weight, comprising the steps of:

providing a three-dimensional image transfer device having a fabric-forming surface defined between three-dimensional surface features, at least some of said surface features having profiles which converge toward each other in a direction toward said fabric-forming surface, said image transfer device defining drain openings positioned between adjacent ones of said three-dimensional surface features;

positioning a precursor web having a length on said image transfer device, wherein said precursor web consists of relatively lightly bonded continuous polymeric filaments, said precursor web having a basis weight from about 10 to about 30 grams per square meter;

hydroentangling said precursor web to form said low basis weight fabric by application of high pressure liquid streams thereto so that bonds between the polymeric filaments of said precursor web are broken to unbond the filaments, and the filaments of said web are rearranged by the fabric-forming surface of said image transfer device, including moving at least some of said filaments off of said three-dimensional surface features of said forming surface to regions of said forming surface between adjacent ones of said three-dimensional surface features; and said precursor web being hydroentangled at a rate of at least 80 feet/minute in a direction along the length of said web so that the filaments of said precursor web are moved into a compacted form between adjacent ones of said three-dimensional surface features and subjected to hydroentanglement in said compacted form to form said fabric without substantially altering the basis weight of said precursor web; and removing the low basis weight fabric from said fabric-forming surface, said fabric having a cross-direction tensile strength of at least about 64 grams/cm, and a machine direction tensile strength of at least about 242 grams/cm.

2. A process for making a low basis weight nonwoven fabric in accordance with claim 1, wherein said three-dimensional image transfer device comprises a pyramidal array.

3. A process for making a low basis weight fabric in accordance with claim 1, wherein:

said precursor web is bonded no more than minimum tensile strength which permits winding and unwinding of said precursor web.

4. A process for making a low basis weight fabric in accordance with claim 1, wherein:

said fabric has a machine-direction tensile strength of at least about 550 grams per centimeter.

5. A process of making a nonwoven fabric having a low basis weight, comprising the steps of:

providing a precursor web having a length, said precursor web consisting of spunbonded continuous polymeric filaments, and having a basis weight from about 10 to about 30 grams per square meter;

providing a three-dimensional image transfer device;

positioning said precursor web on said three-dimensional image transfer device;

hydroentangling said precursor web to form a low basis weight fabric by application of high pressure liquid streams thereto so that bonds between said filaments are broken, and the filaments rearranged on the three-dimensional image transfer device, and removing said fabric from said three-dimensional image transfer device, wherein said low basis weight fabric has a bulk between about 0.29 to 0.38, a cross-direction tensile strength of at least about 64 grams per centimeter, and a machine direction tensile strength of at least about 242 grams per centimeter.

6. A process of making a nonwoven fabric having a low basis weight in accordance with claim 5, wherein:

said low basis weight fabric has a machine direction tensile strength of at least about 550 grams per centimeter.

7. A process of making a nonwoven fabric having a low basis weight in accordance with claim 5, wherein:

said three-dimensional image transfer device comprises a pyramidal array.

* * * * *